US008777445B2

(12) United States Patent
Gourdie et al.

(10) Patent No.: US 8,777,445 B2
(45) Date of Patent: Jul. 15, 2014

(54) CANDLE COVER

(76) Inventors: Jennifer Leigh Gourdie, Kirkland, WA (US); Terri Lee Augustyn, Kirkland, WA (US)

( * ) Notice: Subject to any disclaimer, the term of this patent is extended or adjusted under 35 U.S.C. 154(b) by 337 days.

(21) Appl. No.: 13/212,086

(22) Filed: Aug. 17, 2011

(65) Prior Publication Data

US 2012/0044671 A1 Feb. 23, 2012

Related U.S. Application Data

(60) Provisional application No. 61/374,865, filed on Aug. 18, 2010.

(51) Int. Cl.
*F21L 4/02* (2006.01)

(52) U.S. Cl.
USPC ..... 362/190; 362/392; 362/806; 362/810

(58) Field of Classification Search
USPC ..... 362/161, 166, 167, 171–174, 181, 182, 362/311.06, 311.15, 351, 352, 355, 357, 362/359–361, 392, 806, 810, 184, 190, 202, 362/208
See application file for complete search history.

(56) References Cited

U.S. PATENT DOCUMENTS

| | | | | |
|---|---|---|---|---|
| 5,154,600 | A * | 10/1992 | Sylvestre | 431/253 |
| 8,087,214 | B1 * | 1/2012 | Thuesen et al. | 53/445 |
| 2006/0181874 | A1 * | 8/2006 | Tsai et al. | 362/255 |
| 2010/0046240 | A1 * | 2/2010 | Marden | 362/392 |

* cited by examiner

*Primary Examiner* — Thomas Sember
(74) *Attorney, Agent, or Firm* — Schmeiser, Olsen & Watts LLP

(57) ABSTRACT

A candle cover is disclosed which includes a tubular sheath of light-filtering material with a top end, a bottom end, and an opening at each end. A hem surrounds each opening. The tubular sheath is place over a candle body such that light transmitted through the candle body from the candle light source is filtered by the tubular sheath of light-filtering material to create a decorative pattern. The light-filtering material can filter light in many different ways, including by modifying the percent of light transmitted through the material, by modifying the percent of light reflected by the material, by modifying the color of light reflected or transmitted by the material, or by light refraction or light diffraction. A method of decorating a candle is disclosed which includes the steps involved in forming a tubular sheath of light-filtering material with a hemmed opening at each end, and inserting a candle into the tubular sheath such that the tubular sheath filters light transmitted through the candle body and the tubular sheath in a decorative pattern.

9 Claims, 7 Drawing Sheets

CANDLE COVER

CROSS REFERENCE TO RELATED APPLICATION[S]

This application claims priority to U.S. Provisional Patent Application entitled "CANDLE COVER," Ser. No. 61/374,865, filed Aug. 18, 2010, now pending, the disclosure of which is hereby incorporated entirely herein by reference.

BACKGROUND OF THE INVENTION

1. Technical Field

This invention relates generally to candles and more specifically to decorative candle accessories.

2. State of the Art

Candles are a popular decorative item in households and businesses. Before electricity was developed, candles were used primarily for lighting. Even then, however, candles were also appreciated for their decorative qualities—similar to today's light fixtures which provide lighting but also add to the décor of a house. Candles today are used mostly for decoration. Today there are electric candles which provide the decorative lighting element of a candle without the danger and environmental effects of the flame. Decorative candles are made by adding color and shape to the wax or other material that makes up the candle body. The light from the candle's light source passes through the candle body to create the muted candle lighting effect so popular.

The drawback of using the candle body material itself to create the decorative effect from a candle is that the candle body material cannot be changed once the candle is created. Once a candle is created from wax that has a certain color, size, and shape, the decorative pattern belonging to that candle is fixed. Today it is desirable to have decorative candles which can change pattern and theme to fit different decorative needs as desired. Thus, there is a need for a decorative candle and accessories for candles which allow the user to change the decorative pattern of the candle body as desired.

Another drawback of traditional wax candles is that the wax is used up as the candle burns. A particular decoratively patterned candle is eventually used up as the wax is burned and must be discarded and the decorative pattern is lost. There is a need for a decorative candle accessory where the decorative pattern can be re-used on multiple candles as the wax of a particular candle is depleted.

Accordingly the invention described provides decoratively patterned accessories for candles which can be re-used on multiple candles, and can be used to change the decorative pattern and theme of candles and candle accessories as desired.

DISCLOSURE OF THE INVENTION

The present invention relates to candles and more specifically to decorative candle accessories. A candle cover is disclosed which includes a tubular sheath of light-filtering material with a top end, a bottom end, and an opening at each end. A hem surrounds the opening at the top end and a hem surrounds the opening at the bottom end. In some embodiments the hem encases a plastic elastic band. In some embodiments the hem encases a double-sided tape. The tubular sheath is placed over a candle body such that light transmitted through the candle body from the candle light source is filtered by the tubular sheath of light-filtering material to create a decorative pattern. The tubular sheath of light-filtering material can filter light in many different ways. In some embodiments the light-filtering material filters light by modifying the percent of light transmitted through the material. In some embodiments the light-filtering material filters light by modifying the percent of light reflected off of the material. In some embodiments the light-filtering material filters light by varying the color of light transmitted through or reflected off of the material. In some embodiments the light-filtering material filters light by light refraction. In some embodiments the light-filtering material filters light by light diffraction. In some embodiments the candle cover is scented. In some embodiments the candle cover releases insect repellent.

A decorative item is disclosed which includes a candle, the candle including a light source and a transmissive candle body. In some embodiments the candle body is translucent. In some embodiments the candle body is transparent. The decorative item according to the invention includes a candle cover encasing the candle body, where the candle cover creates a decorative pattern in response to light traveling from the light source through the candle body and through the candle cover. The candle cover filters light traveling from the light source through the candle body and the candle cover to create a decorative pattern. The candle cover can filter light by varying the percent of light transmission through the candle cover, or by light refraction or light diffraction.

A decorative candle is disclosed which includes a candle with a candle body and a light source, and a flexible sheet of light-filtering material. The flexible sheet of light-filtering material is electrostatically adhered to the outer surface of the candle body, where the flexible sheet of light-filtering material filters light transmitted through the candle body to create a decorative pattern. The light-filtering material can filter light by modifying the percent of light transmitted through the candle cover or by modifying the percent of light reflected off of the candle cover. In some embodiment the light-filtering material refracts light transmitted through the candle body. In some embodiment the light-filtering material diffracts light transmitted through the candle body.

A candle cover kit is disclosed which includes a candle with a light source and a candle body, and a candle cover, where the candle cover creates a decorative pattern by filtering light transmitted through the candle body. The candle cover kit also includes a matchbox with a decorative pattern, where the decorative pattern of the matchbox coordinates with the decorative pattern created by the candle cover. In some embodiments the matchbox contains batteries. In some embodiments the matchbox contains matches.

A method of decorating a candle is disclosed which includes the step of forming a rectangle of elastomeric light-filtering fabric, wherein the rectangle has a top edge, a bottom edge, and two opposing side edges. The method of decorating a candle also includes the steps of placing a plastic elastic band along both the top and the bottom edge of the rectangle of elastomeric light-filtering fabric, and hemming each of the top and the bottom edges such that each hem encloses the corresponding plastic elastic band. In some embodiments a double-sided tape is placed along the top and bottom edge and encased by each corresponding hem instead of using the plastic elastic band. The method of decorating a candle also includes the step of sewing together the two opposing sides of the rectangle of light-filtering fabric to create a tubular sheath of elastomeric light-filtering fabric with a hemmed opening at each of the top and the bottom ends. The method also includes the step of inserting a candle into the tubular sheath such that the tubular sheath filters light transmitted through the candle body and through the tubular sheath into a decorative pattern. In some embodiments the method of decorating a candle includes the step of designing a decorative light-filtering pattern. In some embodiment the step of designing a decorative light-filtering pattern includes designing a decorative pattern with both decorative light reflective and decorative light transmissive properties. In some embodiments the method of decorating a candle includes implementing the decorative light-filtering pattern in an elastomeric light-filtering material.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the invention relate to candles and decorative candle accessories. The decorative effect of candles has long been appreciated, to the extent that even though candles are no longer needed for lighting purposes, their popularity and use has not diminished. Candles continue to be popular decorative items due to their unique lighting characteristics. The decorative effect of candles is created by the flame, the decorative effects of the flame reflecting off the candle body, and also by the interplay of light from the flame as it travels through the candle body, especially in larger diameter candles as the candle body is consumed in the center and the flame is inset into the candle body. Candles have become so popular for decoration and effect that electric bulbs are now used as the light source in some candles today. This eliminates the drawbacks of using a flame as the light source—including the danger from the open flame and the emissions created by the burning of the wax—but retains the decorative lighting effect created by light traveling through the candle body.

Figure 1:
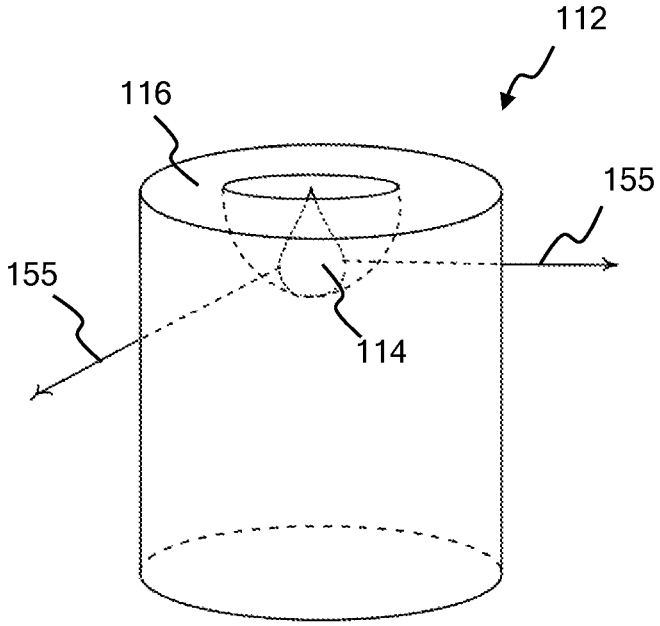
FIG. 1 is an illustration of candle 112 including candle body 116 and light source 114.

Candles come in many different shapes, sizes, and types. FIG. 1 shows an example of one common form of a candle 112. Candle 112 includes light source 114 and candle body 116. In traditional wax candles, light source 114 would be a burning flame, but light source 114 can be any light-emitting element, for example but not by way of limitation, a light bulb or a light-emitting diode (LED). In the embodiment of candle 112 shown in FIG. 1, candle 112 is flameless and light source 114 is an electric bulb. Candle body 116 is often translucent so that light 155 from light source 114 travels through candle body 116, creating the translucent candle lighting effect so popular. Light source 114 can be many different types. Candle 112 can be a traditional wax candle with flame light source 114. Electric bulbs and other non-flame light sources 114 have become popular options for candle 112. Candles with electric light sources 114 can be battery powered or wall-plug powered. Candle body 116 can be made of wax or other suitable translucent or transparent materials. Wax is still a popular choice for candle body 116 because of its translucent and decorative qualities. In flameless candles 112, glass or plastic is another popular choice for candle body 116, including clear glass with wax inside, or translucent glass or sandblasted glass. Any solid material, transparent, opaque, or translucent, can be used for candle body 116.

Figure 2:
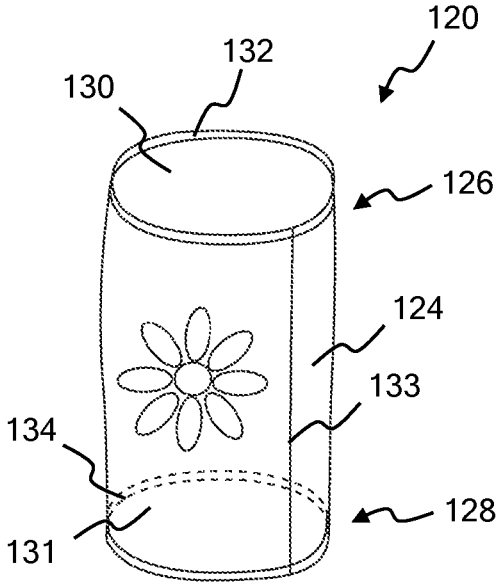
FIG. 2 is a perspective view of one embodiment of candle cover 120 according to the invention.
Figure 3:
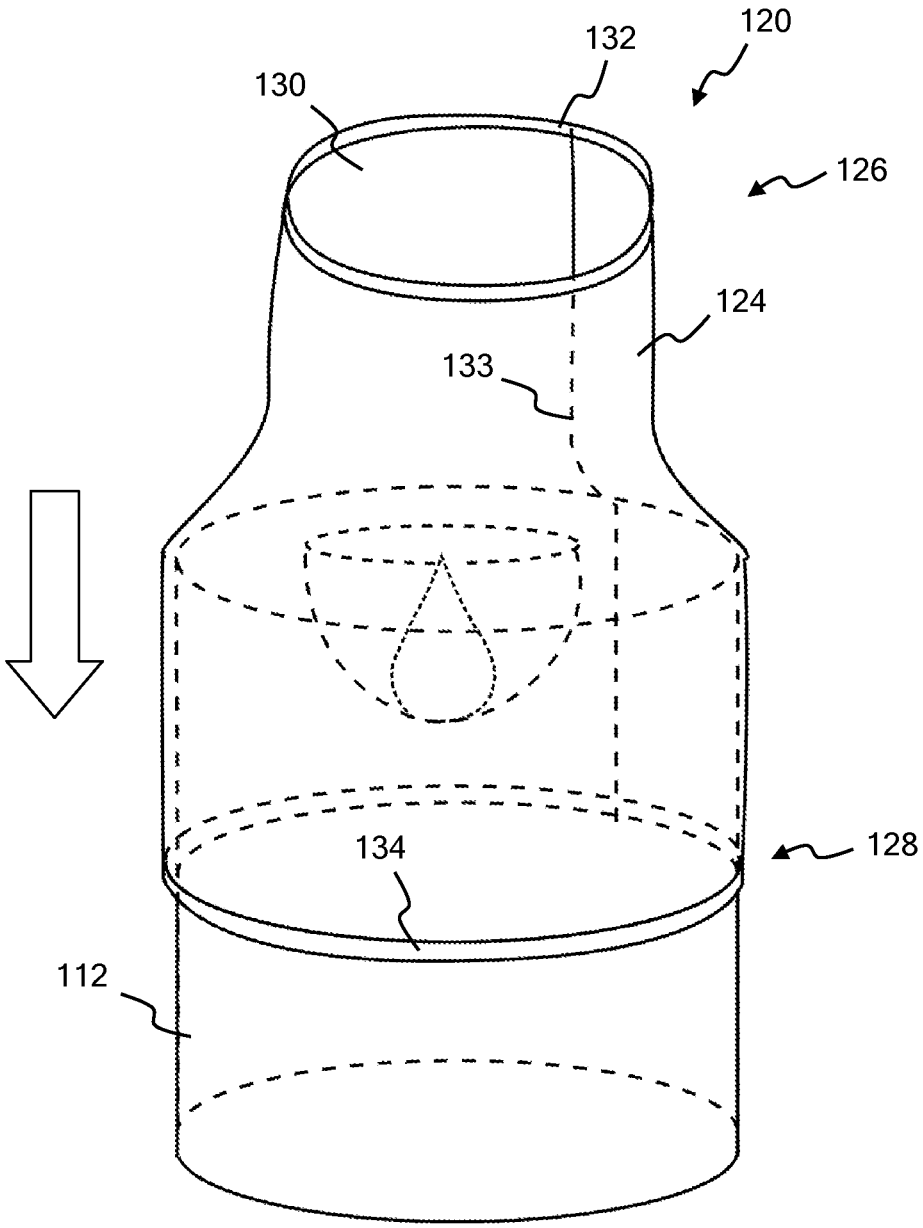
FIG. 3 is a perspective view of candle cover 120 of FIG. 2 being placed over candle 112.
Figure 4:
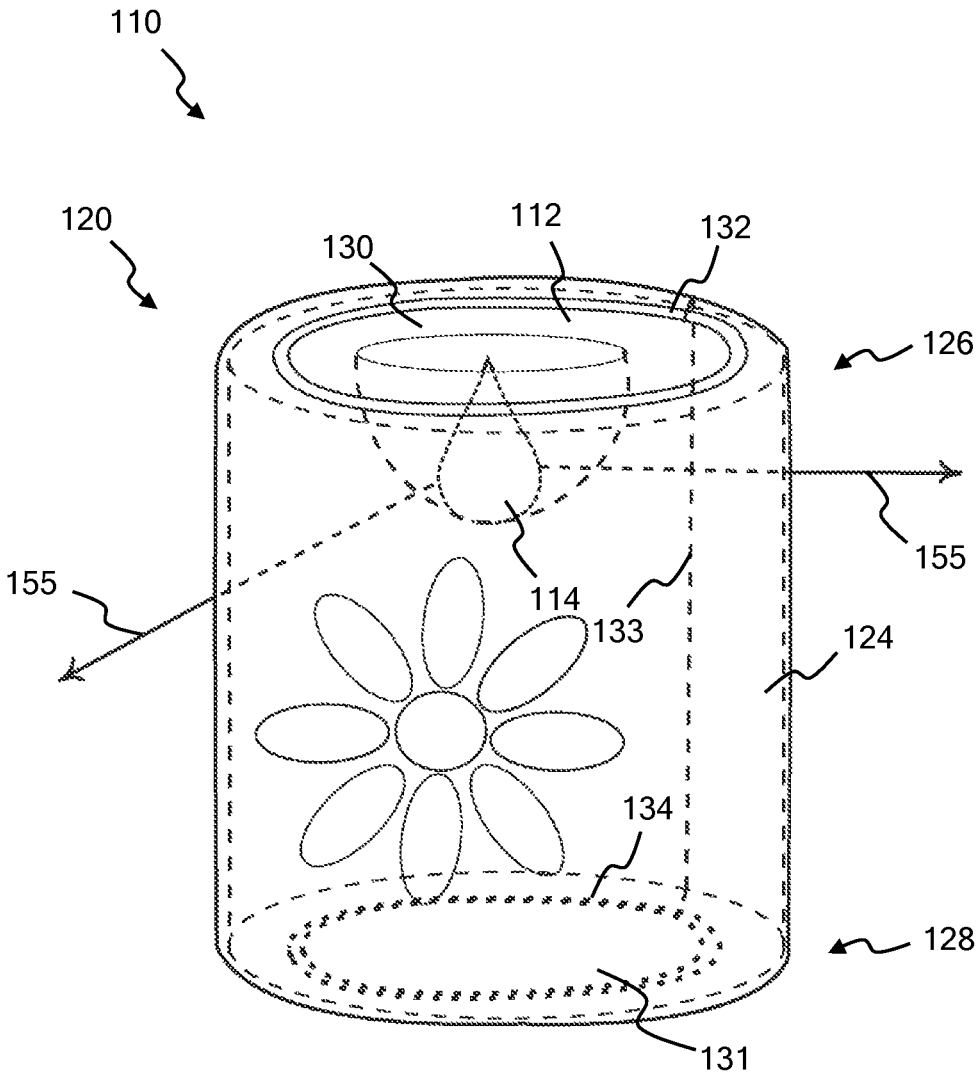
FIG. 4 is a perspective view of decorative candle 110 according to the invention including candle 112 with candle cover 120 of FIG. 2 placed over it such that candle cover 120 filters light 155 transmitting through candle body 116 and through candle cover 120.
Figure 5:
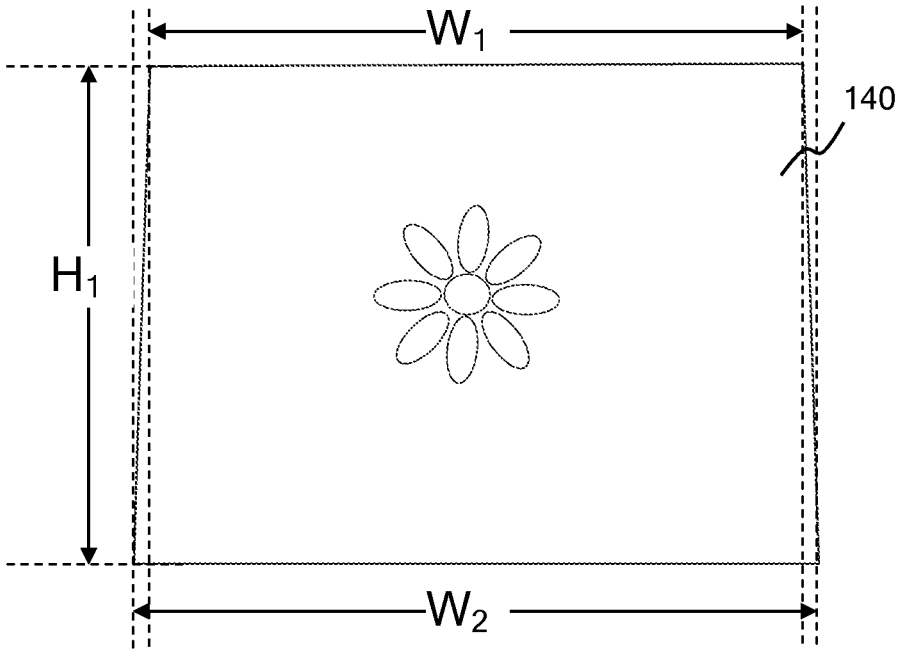
FIG. 5 is a front view of light-filtering material 140.

The disclosed invention includes candle cover 120 as shown in FIG. 2, FIG. 3, and FIG. 4. FIG. 2 is a perspective view of one embodiment of candle cover 120 according to the invention. FIG. 3 is a perspective view of candle cover 120 of FIG. 2 being placed over candle 112. FIG. 4 is a perspective view of decorative candle 110 according to the invention which includes candle cover 120 of FIG. 2 being used to cover candle 112.

Candle cover 120 as shown in FIG. 2 includes tubular sheath 124 of light-filtering material. Candle cover 120 of FIG. 2 is slid over candle 112 of FIG. 1 to create decorative candle 110 according to the invention (FIG. 4). Candle cover 120 is placed over candle body 116 so that light 155 emitted from light source 114 and traveling through candle body 116 passes through candle cover 120. Candle cover 120 filters the light that is transmitted through candle body 116. Candle cover 120 includes a decorative light-filtering pattern such that a decorative pattern is created when light 155 traveling through candle body 116 is filtered by tubular sheath 124 of candle cover 120, as shown in FIG. 4. Candle cover 120 filters light 155, thus imparting the decorative pattern of the light-filtering material used to form tubular sheath 124 onto light 155. Candle cover 120 encases candle body 116 of candle 112, such that candle cover 120 creates a decorative pattern in response to light 155 traveling from light source 114 through candle body 116 and through candle cover 120. The embodiments shown illustrate candle cover 120 used with candles 112. Is to be understood that candle cover 120 according to the invention can be used with any type, size, shape, or variety of candle.

The advantages of using candle cover 120 to decorate candle 112 are numerous. Candle cover 120 can be removed from candle 112 and changed to a different candle cover 120 with a different decorative pattern. Thus decorative candle 110 can be used to create different decorative patterns and match different decorative themes by changing candle cover 120. Candle cover 120 can be re-used on multiple candles 112 as candles 112 are used up, become old, or are otherwise not being used. Candle cover 120 can be washed and re-used numerous times. Candle cover 120 can be made to coordinate with the decorative patterns and colors used in other decorative items in households such as bedspreads, window coverings, and wallpaper, for example. Candle cover 120 can be made flame retardant so it can be used with a candle 112 with a flame light source 114 or a candle 112 with an electric light source 114, or any type, size, or shape of candle.

Candle cover 120 according to the invention can take many forms. Candle cover 120 in the embodiment shown in FIG. 2 through FIG. 4 includes tubular sheath 124 of light-filtering material, with first opening 130 at top end 126 and second opening 131 at bottom end 128 of tubular sheath 124. Hem 132 surrounds opening 130 at top end 126 of candle cover 120. Hem 134 surrounds opening 131 at bottom end 128 of candle cover 120. Hem 132 and 134 ensure that candle cover 120 fits snugly on candle 112 and stays in place at top end 126 and bottom end 128 of candle 112. Hem 132 and 134 help to couple candle cover 120 to candle 112. In some embodiments hem 132 or hem 134, or both, contain tape or an elastic element to help candle cover 120 lay flat and stay in place on candle 112. Tubular sheath 124 in this embodiment is made from an elastomeric light-filtering fabric so that tubular sheath 124 stretches to fit candle 112. The snug fit of elastomeric light-filtering tubular sheath 124 and hem 132 and 134 couple candle cover 120 to candle 112.

Tubular sheath 124 can take many different forms and be made by any number of methods. In the embodiment shown in FIG. 2 through FIG. 4, and FIGS. 5, 7 and 8, tubular sheath 124 of light-filtering material 140 is made by starting with a quadrilateral of light-filtering material 140 with top end 126, bottom end 128, and two opposing sides. In some embodiments, the quadrilateral shape of light-filtering material 140 may include a height $H_1$, a width of the top end of $W_1$ and a width of the bottom end of $W_2$, wherein $W_2$ is greater than $W_1$. A top constricting device 170, such as, but not limited to a plastic elastic band, is placed along top end 126, and then hem 132 is sewn in top end 126 so that hem 132 encases the top constricting device 170. Similarly, a bottom constricting device 172 is placed along bottom end 128. Hem 134 is sewn along bottom end 128 such that hem 134 encases the bottom constricting device 172 placed along bottom end 128. The two opposing sides are then sewn together at seam 133 to create tubular sheath 124 with hem 132 surrounding opening 130 at top end 126 and hem 134 surrounding opening 131 at bottom end 128. Encasing a constricting device 170 and 172 in hem 132 and 134, respectively, prevents buckling of the light-filtering fabric 140 along seam 133, and allows the light-filtering fabric 140 to lie flat against the surface of candle body 116. This creates candle cover 120 which lies flat on candle 112 even after candle cover 120 has been repeatedly placed over and removed from different candles 112. In this way tubular sheath 124 includes hem 132 and hem 134, where hem 132 and hem 134 each include a constricting device 170 and 172 respectively.

Hem 132 and hem 134 of candle cover 120 encloses other constricting or fabric-shaping elements in some embodiments. In some embodiments one or both of hems 132 and 134 enclose a constricting device 170 and 172 other than a plastic elastic band. These constricting devices included in hems 132 or 134 act to constrict openings 130 and 131 so that tubular sheath 124 stays in place on candle 112, and make it easy to slide candle cover 120 over candle 112. In this way constricting devices 170 and 172 can be used to couple tubular sheath 124 to candle 112. In some embodiment constricting devices 170 and 172 comprising elastic are sewn into or encased by hems 132 or 134. In some embodiments constricting devices 170 and 172 that are drawstrings are sewn into or encased by hems 132 or 134. Any constricting device 170 or 172 which will allow candle 112 to be placed inside of tubular sheath 124, and then constrict openings 130 and 131 such that sheath 124 does not come off of candle 112 will work as constricting devices enclosed by hems 132 or 134. In this way tubular sheath 124 can include constricting devices enclosed by hems 132 or 134. In this way hem 132 or hem 134 can include a constricting device.

In some embodiments hem 132 or hem 134 of tubular sheath 124 includes other elements which control the shape and flatness of candle cover 120 or help to couple candle cover 120 to candle 112. In some embodiments hem 132 or hem 134 includes a flat non-elastic element which holds top 126 or bottom 128 flat against candle 112. In some embodiments hem 132 or hem 134 includes an element which is partially non-elastic and partially elastic. In some embodiments double-sided tape is enclosed in hem 132 and hem 134 instead of a plastic elastic band. In some embodiments hem 132 or hem 134 include a double-sided tape attached at seam 133 with an elastic element. In some embodiments hem 132 or hem 134 include a metal or wire element. Hem 132 or hem 134 of tubular sheath can contain many different types of elements which couple candle cover 120 to candle 112. Hem 132 or hem 134 can contain many different types of elements which control the shape or flatness of candle cover 120.

Referring again to FIG. 2 through FIG. 4, seam 133 is sewn with cotton thread. By using 4-way stretch fabric for tubular sheath 124 sewn with a hem encasing an elastic band, candle cover 120 can accommodate candles 112 of varying diameters. For example, a candle cover 120 which is made to fit a 3" diameter candle 112 can accommodate a candle 112 with a diameter ranging from about 2¾" to about 4". In some embodiments candle cover 120 made to fit a 3" diameter candle accommodates candles 112 with a diameter ranging from about 2¾" to about 3¾". In some embodiments candle cover 120 seam 133 is sewn with nylon thread. In some embodiments candle cover 120 seam 133 is sewn with elastic thread. In some embodiments seam 133 is sewn using longer than normal stitches to allow candle cover 120 to accommodate larger diameter candles 112.

Tubular sheath 124 in the embodiments shown is made from a 4-way stretch material which stretches to fit candle 112 snugly. Tubular sheath 124 can be made from any elastomeric or non-elastomeric fabric or material which can cover candle 112 and decoratively filter light 155 from candle 112. Tubular sheath 124 is made in different sizes, lengths, diameters, and shapes to fit over different sizes and shapes of candles 112. In some embodiments tubular sheath 124 is made of a mesh nylon/spandex fabric. In some embodiments tubular sheath 124 has an opening at top end 126 but no opening at bottom end 128. In this embodiment candle 112 is placed inside tubular sheath 124 through opening 130 at top end 126.

In some embodiments candle cover 120 is not a tubular sheath. Candle cover 120 can be a material of any shape which covers a portion of candle body 116 of candle 112 and filters light 155 into a decorative pattern. In some embodiments candle cover 120 is a flat piece of flexible light-filtering material which is wrapped around candle 112. Candle cover 120 in this embodiment can be coupled to candle 112 with ties, snaps, hook and loop attachment, or other coupling means. Candle cover 120 can be rectangular, round, oval, or triangular. Candle cover 120 can be shaped into any shape, such as flowers, cartoon characters, geometric patterns, or faces, for example. Candle cover 120 is a piece of light-filtering material of any size and shape which covers a portion of candle 112 and filters light 155 transmitting through candle body 116 and candle cover 120 into a decorative pattern.

Candle cover 120 is made of light-filtering material. The light-filtering characteristics of candle cover 120 are what gives candle cover 120 its decorative properties. Light-filtering means the light is modified in characteristics as it passes through the light-filtering material. The light-filtering characteristics of candle cover 120 can be determined by the type of material used, as well as the type of dye and dying methods used. In some embodiments a dye-sublimation process is used where the background color is omitted to increase the amount of light transmitted through the light-filtering material which comprises candle cover 120. Candle cover 120 can filter light using any of several light modification, or filtering, means. Candle cover 120 can be made of a material which filters light either reflectively or transmissively or both. The transmissive light-filtering characteristics of tubular sheath 124 of candle cover 120 are often used to provide decoration at night or other low-ambient light situations, where light 155 from candle 112 light source 114 is creating room light. The reflective light-filtering characteristics of candle cover 120 are often used to provide decoration in the daytime when ambient room light is reflecting off of candle cover 120. The combination of reflective and transmissive light-filtering properties creates the attractive light moods and themes of decorative candle 110 according to the invention.

Candle cover 120 can use many different means to filter light transmissively and/or reflectively. Candle cover 120 of light-filtering material can filter light by varying the percent of light transmitted through or reflected off of the light-filtering material. Alternatively or additively, Candle cover 120 can be made of a material which filters light by refraction or diffraction to create a decorative pattern.

Candle cover 120 filters light transmissively in some embodiments. Filtering light transmissively means that light 155 emitted from light source 114 is filtered as it transmits through candle cover 120 to create a decorative pattern. FIG. 4 shows an example of a candle cover 120 being used to filter light transmissively to create a decorative pattern. In some embodiments tubular sheath 124 of candle cover 120 is made of light-filtering material which varies the percent of light transmitted uniformly across the visible spectrum. When the light-filtering material comprising candle cover 120 has a pattern made of different areas, each having a different percent of light transmission, where the light transmission does not vary across wavelength, a transmissive grey-scale decorative pattern is created. The decorative pattern can be any pattern, manifesting a change in grey levels in different areas. In this way candle cover 120 can filter light 155 by modifying the percent of light 155 transmitted uniformly across the visible spectrum to create a transmissive grey-scale decorative pattern.

In some embodiments candle cover 120 is made of light-filtering material which varies the percent of light transmitted, where the percent of light transmitted also varies with wavelength across the visible spectrum. This creates a colored pattern of transmitted light, where different areas in the pattern have different amounts of light transmitted, and different areas also transmit different colors of light. The decorative pattern can be any pattern and any color. The decorative pattern can be made to match a theme or a pattern elsewhere in the room or décor. In this way candle cover 120 can filter light 155 by modifying the percent of light 155 transmitted non-uniformly across the visible spectrum to create a transmissive colored decorative pattern.

In some embodiments candle cover 120 is made of light-filtering material which filters light reflectively. Filtering light reflectively means that light reflected off of candle cover 120 is selectively filtered to create a decorative pattern. The light reflected off of candle cover 120 can be room light or sunlight or any other ambient light that is incident on candle cover 120. In some embodiments candle cover 120 is made of light-filtering material which varies the percent of light reflected uniformly across the visible spectrum. When the light-filtering material comprising candle cover 120 has a pattern made of different areas, each area having a different percent of light reflection, where the percent of light reflected does not vary across wavelength, a reflective grey-scale decorative pattern is created. The decorative pattern can be any pattern, manifesting a change in grey levels in different areas. In this way candle cover 120 can filter light by modifying the percent of light reflected uniformly across the visible spectrum to create a reflective grey-scale decorative pattern.

In some embodiments candle cover 120 is made of light-filtering material which varies the percent of light reflected, where the percent of light reflected also varies with wavelength across the visible spectrum. This creates a colored pattern of reflected light, where different areas in the pattern have different amounts of light reflected, and different areas also reflect different colors of light. The reflective decorative pattern can be any pattern and any color. The decorative pattern can be made to match a theme or a pattern elsewhere in the room or décor. In this way candle cover 120 can filter light by modifying the percent of light reflected non-uniformly across the visible spectrum to create a reflective colored decorative pattern. Additional types of candle covers 120 are contemplated that use different light-filtering materials, where the light-filtering material filters light transmissively and reflectively, in some examples uniformly across the visible spectrum to create grey-scale decorative patterns, in some cases non-uniformly across the visible spectrum to create colored decorative patterns. Candle covers 120 can filter light reflectively, transmissively, or both.

In some embodiments candle cover 120 is made of light-filtering material which filters light 155 using light refraction. Light refraction is when light traveling through an object is bent, changing the direction of travel of the light. Light refraction can be implemented in either a transmissive or a reflective mode. Light-refracting fabrics and materials are made by including light-refracting transmissive or reflective elements in a material, such as beads, or prisms. In one embodiment a decorative light-refracting fabric will use small prisms to refract light into decorative rainbows. In this way candle cover 120 can include a light-filtering material which refracts light 155 into a decorative pattern.

In some embodiments candle cover 120 is made of a light-filtering material which filters light 155 by using light diffraction. Light diffraction occurs when light is scattered at the molecular level into a pattern, often called a diffraction pattern. Light diffraction can be implemented in either a reflective or a transmissive mode. Light diffracting materials are made by including light-diffracting elements in a fabric or material, which create a decorative light diffraction pattern. Often small light-diffracting elements are created to form decorative rainbow reflections, such as those seen when light reflects off of a compact disc (the small grooves made in the compact disc which carry the data also diffract light falling on the compact disc). In this way candle cover 120 can include a light-filtering material which diffracts light 155 into a decorative pattern.

Candle cover 120 according to the invention can use any means to filter light 155 into a decorative pattern. The light-filtering material which makes up candle cover 120 can filter light transmissively, reflectively, refractively, or diffractively, or any combination of these means for filtering light. In some embodiments the light-filtering material of tubular sheath 124 filters light using other light-filtering means.

In some embodiments tubular sheath 124 of candle cover 120 can be made to have desirable properties other than creating a decorative pattern. In some embodiments tubular sheath 124 is made to release a scent. In some embodiment a microcapsule with a desired scent is added to the material comprising tubular sheath 124 such that tubular sheath 124 releases a scent. In some embodiments the scent is released when candle cover 120 is at a specific temperature. In some embodiments candle cover 120 includes other means for releasing a scent.

In some embodiments candle cover 120 is designed to provide insect repellent capabilities. In some embodiments a microencapsulated insect repellent can be applied to the material comprising tubular sheath 124 such that candle cover 120 will repel insects from an area surrounding candle cover 120. In some embodiments candle cover 120 includes other means for providing an insect repellant capability.

In some embodiments candle cover 120 is made of ecologically friendly material. In some embodiments the material can be recycled. In some embodiments the material includes no harmful elements. In some embodiments the material can be made to degrade harmlessly.

Figure 6:
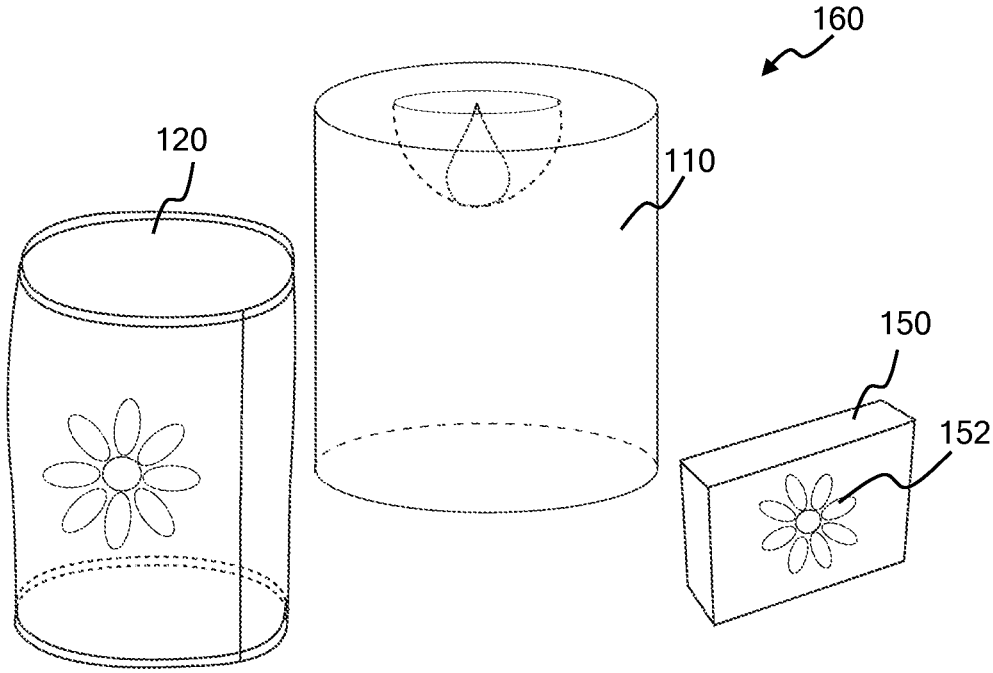
FIG. 6 shows an embodiment of candle kit 160 according to the invention, including decorative candle 110 and matchbox 150.
Figure 7:
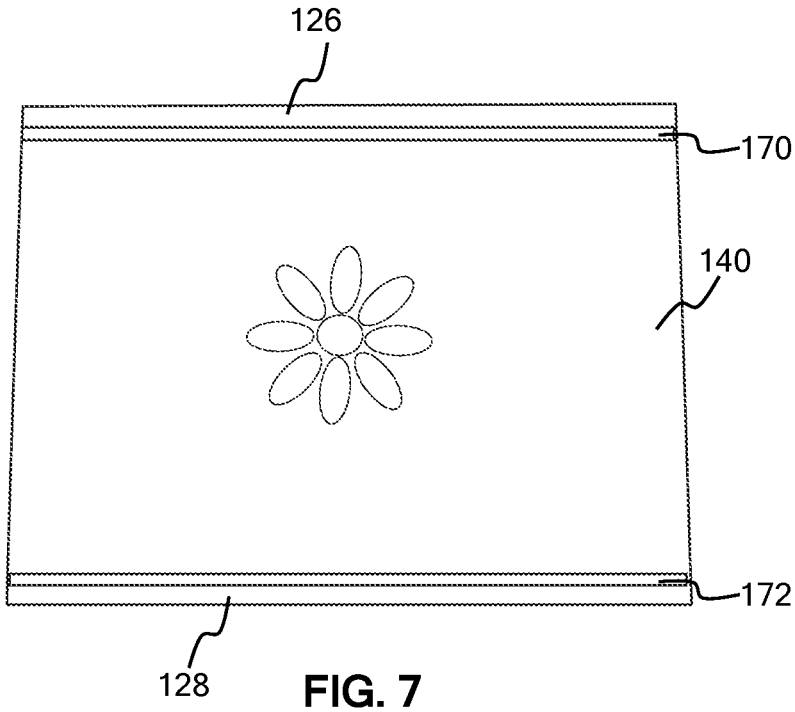
FIG. 7 shows a front view of a light filtering material 140 with constricting devices 170 and 172 prior to hemming.
Figure 8:
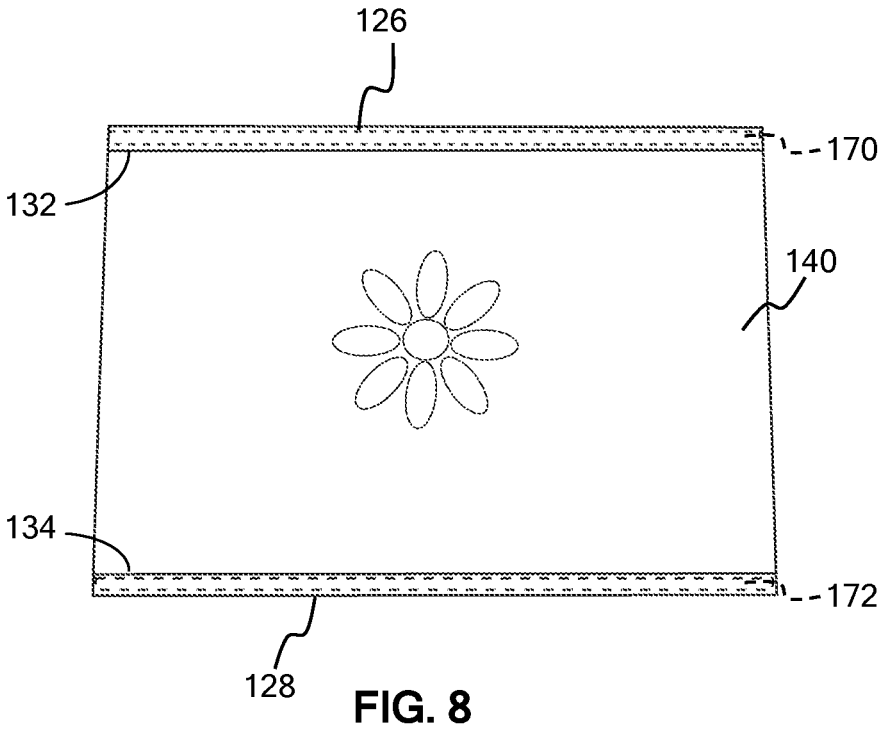
FIG. 8 shows a front view of a light filtering material 140 with constricting devices 170 and 172 after hemming.

FIG. 6 shows an embodiment of the invention as kit 160. Kit 160 includes candle cover 120 covering candle 112, and matchbox 150. In some embodiments kit 160 only includes candle cover 120 and match box 150 (no candle 112 included). Matchbox 150 has decorative pattern 152 which coordinates with the decorative pattern of the light-filtering material of candle cover 120. Matchbox 150 can includes matches for flame candles, and/or batteries for electric candles. Kit 160 provides additional coordinated accessories for decorating according to a theme. In some embodiments kit 160 includes several sizes of candles 112. In some embodiments kit 160 include several sizes of candle covers 120. In some embodiments kit 120 includes candle covers 120 made from different types of light-filtering materials.

Figure 9:
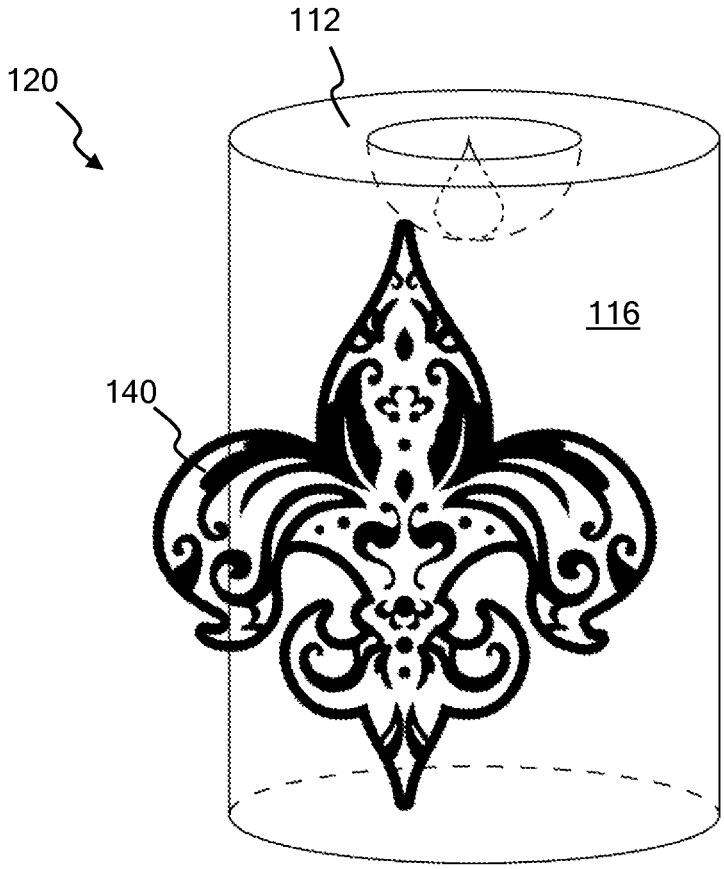
FIG. 9 shows a perspective view of a light filtering flexible material being adhered to a decorative candle 112.

As mentioned previously, in some embodiments of the invention candle cover 120 takes a form other than a tubular sheath. FIG. 9 shows an example of an embodiment of candle cover 120 where candle cover 120 is made of a sheet 140 of flexible light-filtering material. Sheet 140 of light-filtering material is adhered to the outer surface of candle body 116 to filter light into a decorative pattern. Sheet 140 in this embodiment is a flexible sheet 140 of vinyl which wraps around candle 112 and has a decorative black and white fleur-de-lis pattern. Sheet 140 is adhered to the outer surface of candle body 116, as shown in FIG. 9 with a portion of the flexible sheet adhered to the candle with a portion in the process of being adhered. In this embodiment sheet 140 is sized so that it does not overlap itself. However other embodiments overlap itself slightly. Embodiments that have a sheet 140 that overlaps itself allows sheet 140 to adhere to itself and improves the coupling of sheet 140 to candle 112. In some embodiments, sheet 140 of candle cover 120 filters light reflectively and transmissively in a grey-scale decorative pattern. In some embodiments sheet 140 filters light by refraction. In some embodiments sheet 140 filters light by diffraction. In some embodiments sheet 140 has a shape other than rectangular. In this way candle cover 120 includes flexible sheet 140 of light-filtering material electrostatically adhered to the outer surface of candle body 116 of candle 112, where flexible sheet 140 filters light transmitted through candle body 116 to create a decorative pattern. Further the sheet 140 may be adhered by various ways, such as electrostatic adhering, such as with static vinyl, or other means, such as an adhesive.

Further, in some embodiments where the flexible sheet 140 wraps fully around the candle 112, the sheet 140 may be designed to follow the natural diameter of a candle 112 to help produce a seamless seam. A blank margin, which is clear of any print, helps the two edges to adhere together for a secure fit to the flameless candle. Further. There may be a white underlay under any color displayed on sheet 140 to deepen color saturation and to emphasize light illuminating artwork where color is excluded.

In other embodiments where the flexible sheet is a decal size or does not wrap fully around the candle 112, the sheet 140 may be a static vinyl sheet and are cut so that the illustrations on the sheet 140 can be lifted from the backing sheet (similar to pulling a sticker from a sticker sheet) and adhered to the side of a flameless candle. With regard to translucency, color is excluded in areas of the illustrations to allow the light from the flameless candle to shine through the illustration. There is improved ability to adhere. The margin is kept small, such as but not limited to ⅛" inch around each illustration, so that as little extra material possible is visible beyond the illustration itself, yet allows enough material to ensure the decal will adhere well without slipping down the wax or completely falling off the candle 112. Additionally, excluding color in areas of the illustrations helps the decal of flexible material 140 to adhere to the candle 112.

The sheets 140 that fully wrap around the candle 112, as well as sheets 140 that do not wrap around the candle 112 are all reusable. The sheets 140 can be replaced in the on the original backing sheet and reused at a later point in time. Often, the type of candle 112 that these embodiments are used with is a flameless candle.

Figure 10:
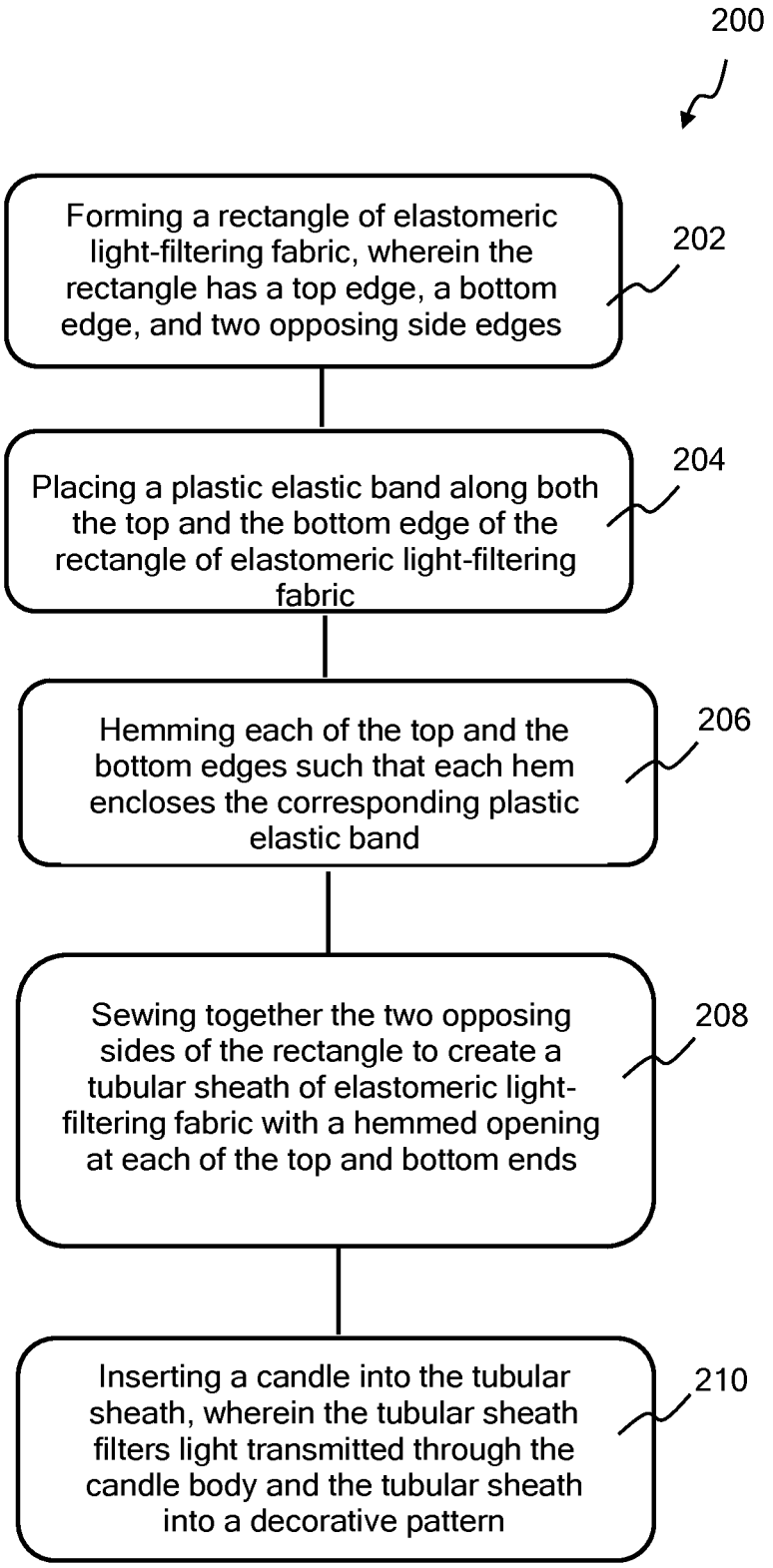
FIG. 10 illustrates method 200 of decorating a candle according to the invention.

FIG. 10 illustrates a method 200 of decorating a candle according to the invention. Method 200 includes step 202 forming a rectangle of elastomeric light-filtering fabric, wherein the rectangle has a top edge, a bottom edge, and two opposing side edges. Method 200 also includes step 204, placing a plastic elastic band along both the top and the bottom edge of the rectangle of elastomeric light-filtering fabric, and step 206, hemming each of the top and the bottom edges such that each of the top and the bottom hem encloses the corresponding plastic elastic band. Method 200 also includes step 208, sewing together the two opposing sides of the rectangle of light-filtering fabric to create a tubular sheath of elastomeric light-filtering material with an opening at each of the top and bottom ends and a hem surrounding each opening. And method 200 includes step 210, inserting a candle into the tubular sheath such that the tubular sheath filters light transmitted through the candle body and the tubular sheath into a decorative pattern.

Method 200 can include many other steps. In some embodiments method 200 includes the step of designing a decorative light-filtering pattern. In some embodiment the step of designing a decorative light-filtering pattern includes designing a decorative pattern with both decorative light-reflective and decorative light-transmissive properties. In some embodiments method 200 includes implementing the decorative light-filtering pattern in an elastomeric light-filtering material. In some embodiments method 200 includes infusing a light-filtering material with a scent. In some embodiments method 200 includes infusing a light-filtering material with insect repellent.

Step 204 can have numerous variations. In some embodiments step 204 comprises placing double-sided tape along both the top and the bottom edge of the rectangle of elastomeric light-filtering fabric. In some embodiments step 204 includes coupling a constricting device along both the top and the bottom edge of the rectangle of elastomeric light-filtering fabric. In some embodiments step 204 include placing a coupling device along both the top and the bottom edge of the rectangle of elastomeric light-filtering fabric.

Step 206 can have numerous variations. In some embodiments step 206 comprises hemming each of the top and the bottom edges such that each hem encases the corresponding double-sided tape. In some embodiments step 206 comprises hemming each of the top and the bottom edges such that each hem encases the corresponding constricting device. In some embodiments step 206 comprises hemming each of the top and the bottom edges such that each hem encases the corresponding coupling device.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, the candle cover 120 can be made to have further decorative properties, such as being sewn in decorative shapes such as animals, people, or other objects. Candle cover 120 can be made opaque such that it hides candle 112 when candle 112 is not in use, and is removed to use candle 112.

The invention claimed is:

1. A decorative item comprising:

a candle comprising a light source and a candle body; and, a candle cover coupled to the candle body, wherein the candle cover filters light transmitted through the candle body and the candle cover to create a decorative pattern;

wherein the candle cover comprises a flexible sheet of light-filtering material, wherein the flexible sheet of light-filtering material is electrostatically coupled to the candle body; and wherein the flexible sheet of light-filtering material has a quadrilateral shape with a top width and a bottom width, where the bottom width is larger than the top width.

2. The decorative item of claim 1, wherein the candle cover is coupled to the candle body after the candle has been formed.

3. The decorative item of claim 1, wherein the candle cover is removably coupled to the candle body.

4. The decorative item of claim 1, wherein the top width further comprises a top width casing; and a top width constricting device contained in the top width casing.

5. The decorative item of claim 4, wherein the bottom width further comprises a bottom width casing; and a bottom width constricting device contained in the bottom width casing.

6. A candle cover kit comprising:

a candle comprising a light source and a candle body;

a candle cover with a first decorative pattern;

and a matchbox with a second decorative pattern, wherein the matchbox contains batteries for the light source.

7. The kit of claim 6, further comprising a plurality of candle covers.

8. The kit of claim 7, further comprising a plurality of candles, wherein each candle comprises a light source and a candle body.

9. The kit of claim 8, wherein each one of the plurality of candle covers is sized to fit a corresponding one of the plurality of candles.

* * * * *